United States Patent [19]

Lalancette et al.

[11] 4,170,515

[45] Oct. 9, 1979

[54] PROCESS FOR BLEACHING PEAT MOSS AND RESULTING PRODUCT

[75] Inventors: Jean-Marc Lalancette; Bernard Coupal, both of Sherbrooke, Canada

[73] Assignee: Johnson & Johnson, New Brunswick, N.J.

[21] Appl. No.: 879,833

[22] Filed: Feb. 21, 1978

[51] Int. Cl.[2] ..... D01B 1/50

[52] U.S. Cl. ..... 162/92; 44/27; 71/24; 536/1; 536/56; 536/57

[58] Field of Search ..... 536/56, 57, 1; 71/24; 44/27; 162/92; 106/163 R, 189

[56] References Cited

U.S. PATENT DOCUMENTS

| | | | |
|---|---|---|---|
| 610,957 | 9/1898 | Zschorner | 162/92 |
| 730,155 | 6/1903 | Py | 162/92 |
| 1,121,099 | 12/1914 | Hellwig | 162/92 |
| 1,420,303 | 6/1922 | Burlin | 162/92 |
| 1,557,338 | 10/1925 | Runkel | 162/92 |
| 4,022,965 | 5/1977 | Goheen | 536/56 |
| 4,056,400 | 11/1977 | Dramantoglu et al. | 536/56 |

FOREIGN PATENT DOCUMENTS 746069 9/1974 South Africa .

OTHER PUBLICATIONS

Chemical Abstracts, vol. 44, #711f, Jan.-Mar. 1950, "Oxidation of Green and Sphagnum Moss by Hydrogen Peroxide" Zhur. Priklad. Khim. (J. Applied Chem.) 22, 882-886 (1949).

Gerge L. et al., "Bleaching with Nascent Gases"—citation is incomplete.

Ukranian Chemical Journal, 19:562 (1953) "On the Adsorptive Properties of Peat."

*Primary Examiner*—Melvyn I. Marquis

*Attorney, Agent, or Firm*—Jason Lipow

[57] ABSTRACT

A process for bleaching peat moss at acid pHs to produce a peat moss product of enhanced color and which substantially maintains its original structure.

70 Claims, 3 Drawing Figures

PROCESS FOR BLEACHING PEAT MOSS AND RESULTING PRODUCT

TECHNICAL FIELD

The present invention relates to a process for bleaching peat moss. The process is carried out under acid conditions and produces a product of improved color. The bleached product also substantially maintains its original structure.

BACKGROUND ART

Peat moss belongs to the genus sphagnum and is a plant that grows from the top while the bottom part dies and changes into peat. Peat moss is a combination of celluloses, lignins, and humic acids. The peat moss leaf is one cell-layer thick. The peat moss or sphagnum cells are thin-walled with large cavities and readily absorb and transport water. These cells have lignified walls. Peat moss absorbs relatively large amounts of water and has the ability to hold that water and, hence, peat moss has found considerable use in the horticultural industry. Furthermore, it is known to use peat moss as an absorbent dressing including a sanitary napkin, tampon, or even in a diaper. It has also been known to form paper from peat moss, and peat moss has been and is presently used as a fuel. In recent years, water treatment techniques have been developed which utilize peat moss. While peat moss has found wide acceptance in horticultural and similar uses, it has not found wide acceptance in absorbent dressing uses. Even though it has excellent absorbent properties, it is believed it has not found use in absorbent dressings because of its color problems; that is, the consumer or user does not like the unduly dark color of peat moss. There are a number of known techniques for bleaching the lignin in various materials such as wood pulp; however, it is believed nobody has been able to obtain peat moss having an acceptable color while maintaining its desirable absorptive characteristics. When utilizing standard bleaching operations in the bleaching of peat moss, the structure of the peat moss is degraded and its absorbent characteristics unduly reduced.

SUMMARY OF THE PRESENT INVENTION

What we have discovered is a method for bleaching peat moss which does not degrade the structure of the peat. Our new bleached peat moss maintains its desirable absorbency characteristics. The method of the present invention also produces a peat moss that has a good color level and makes it suitable for use in absorbent dressings and the like. Furthermore, our new process is economical.

In accordance with the present invention, peat moss is formed into a slurry of a manageable consistency so that it may be pumped and transported. This slurry is treated with active chlorine in combination with an alkali or alkaline earth salt such as a carbonate or hydroxide. The treatment is carried out at a pH of 7 or less. Preferred methods for carrying out this treatment are to treat the peat moss with a calcium or sodium salt while maintaining the pH at 7 followed by adding gaseous chlorine to the slurry while reducing the pH to 3 or 4 or to treat the slurry with sodium or calcium hypochlorite while maintaining the slurry at a pH or 7 or less. After the treatment, the slurry is dewatered to a solids content of 5%, preferably 10% or greater, and then washed with acid to produce a bleached peat moss.

In one embodiment of the present invention, peat moss is initially classified to produce peat moss having a particle size distribution of from 74 microns to about 2000 microns. Preferably, this step is carried out as a wet classification and peat moss having a particle size distribution of from 149 microns to 1410 microns is used. The term "mesh," as used throughout this specification refers to the sieve number used in the Standard U.S. Sieve Series. Hence, the phrase "10 to 100 mesh" means particles of such a size that they pass through the openings of a number 10 mesh screen (2000 microns) and remain on a number 100 mesh screen (149 microns). Material that will not pass through the openings of a 10 mesh screen is not used nor is material used that passes through the openings of a 200 mesh screen. The classified peat moss is diluted with water to a low concentration and treated with calcium carbonate, calcium oxide, calcium hydroxide, or sodium carbonate as desired. The treatment is carried out at a pH of 7 or less. Gaseous chlorine is added to the slurry and the pH reduced to 3 to 4 to bleach the peat moss to a minimum color level. The bleached peat moss is drained and dewatered and washed with water followed by an acid washing to complete the bleaching. The peat may be further dried and may be processed as desired in various manners to be utilized in final products.

The resultant bleached peat moss has a minimum color level as measured on the Hunter L Scale of at least 65 and preferably at least 70 or higher. Our new and improved product of the present invention has a minimum liquid absorption capacity of at least 15 grams of liquid per gram of peat moss and preferably at least 20 grams of liquid per gram of peat moss. In some embodiments of the present invention our new product has maintained the leaf size and structure of the original peat moss; i.e., a one-celled layer thickness. The leaf of our bleached product has a plurality of parallel rows of cells disposed over the surface with the average size of the cell being from about 15 to 40 microns. The leaf itself has dimensions in the range of from 0.3 to 0.8 millimeters.

In a preferred embodiment of the present invention our new and improved bleached peat moss has a particle size distribution of 74 microns to 2000 microns and preferably no more than 15% by weight is smaller than 149 microns. Even more preferred is a peat moss wherein at least 90% by weight of the product has a particle size distribution of from 149 microns to 1410 microns.

DETAILED DESCRIPTION OF THE DRAWINGS

Figure 1:
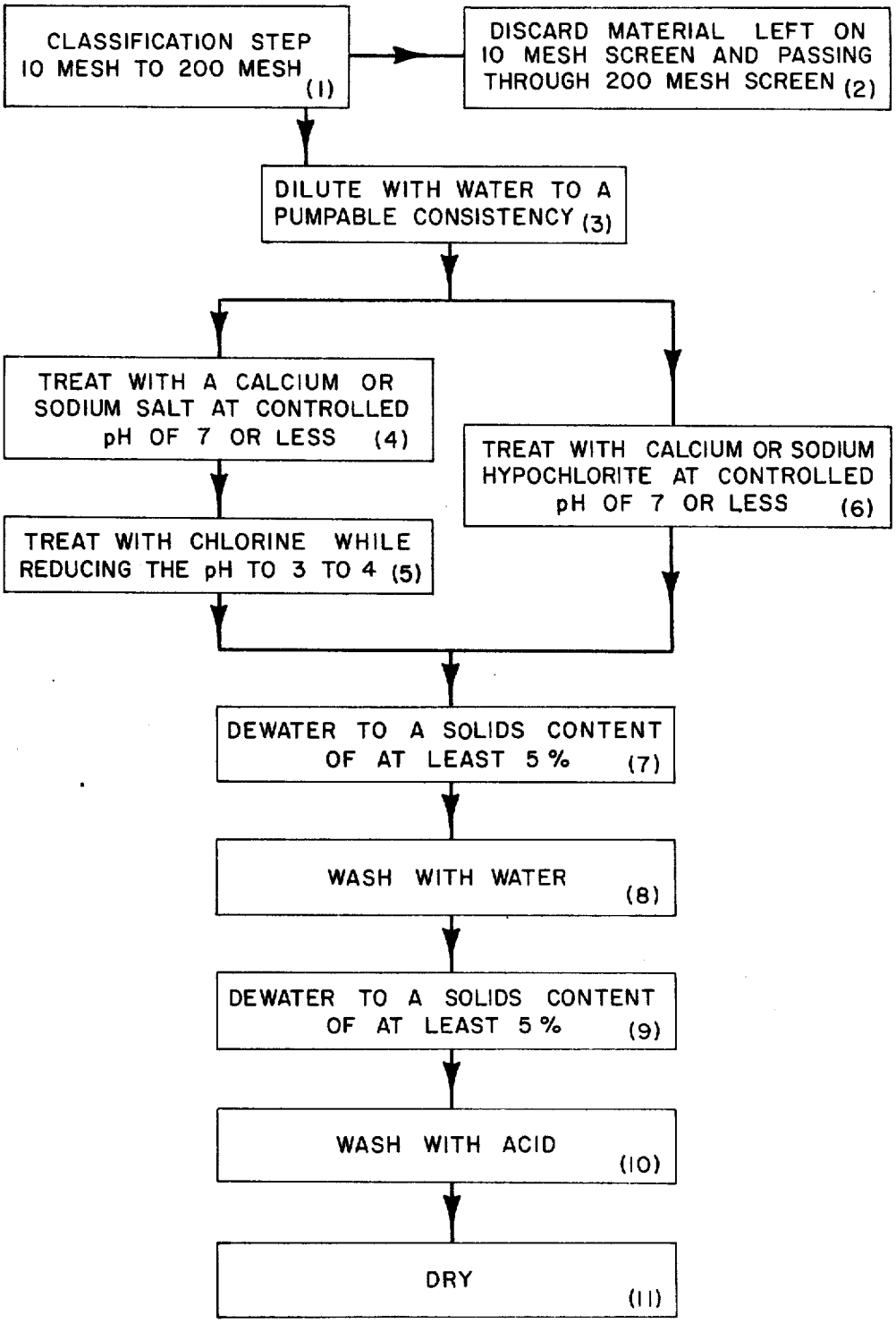
FIG. 1 is a box type process flow sheet which shows the various steps and their relationship to each other in the process of the present invention.

The starting peat moss taken from the bog should have a relatively high absorbency characteristic. By that, it is meant that the peat should hold and contain a multiple times of its weight of water. As preferred, it should contain at least 20 times its weight of water or 20 grams of water per gram of peat, preferably 25 grams of water per gram of peat. The starting peat moss has a color of from about 40 to 55 as measured on the Hunter L Scale. We prefer to start with peat moss having an original color of 45 or higher. Our improved bleaching techniques will increase the color of peat moss generally by about 20 points on the Hunter L Scale. Referring to the flow sheet in FIG. 1, the starting peat moss as taken from the bog is wet classified (Box 1) to remove the extremely fine material (fines) which have low absorbency characteristics and produce dark colors. The classification also removes the large pieces of material including roots, branches, and the like, which are extremely difficult to bleach and add nothing to the absorbency characteristics. The classification is carried out such that anything that remains on a #10 mesh screen (2000 microns) is discarded and anything that passes through a #200 mesh screen (74 microns) is also discarded (Box 2). It is preferred that anything that remains on a #14 mesh screen (1410 microns) is discarded and anything that passes through a #100 mesh screen (149 microns) is discarded to make our new bleaching process even more efficient. In some instances, because of economic considerations, it may be desirable to discard anything passing through a #50 mesh screen (297 microns).

The wet classification is carried out by flowing the peat moss, starting with about a 1% concentration of peat moss in water, through an oscillating screen to a concentration of about 5% of peat moss in water as is well known in classification procedures. Concentrations of peat moss in water from about 1 to 3% have been satisfactory in carrying out the wet classification of peat moss. The desired particle size peat moss or fraction is removed from the screen and placed in a tank or other suitable container to be bleached. Though a wet classification using an oscillating screen is described, other classification methods, even including dry classification, may be used.

The desired peat moss fraction is diluted with water to a manageable slurry, and a slurry is one of a consistency that it can be pumped (Box 3). Easily pumped slurries are those containing from about 1% to 5% solids and we prefer to use pumpable slurries containing from about 1% to 3% solids. The peat moss is placed in a tank at the desired solids concentration and a chemical agent added. The chemical agent in this embodiment of our new process may be calcium carbonate (i.e., ground limestone), calcium oxide, calcium hydroxide (slaked lime) or sodium carbonate. From about 0.4 grams to 1.4 grams of the chemical agent per gram of peat moss and preferably from about 0.8 grams to 1 gram of the chemical agent per gram of peat moss is used.

For ease of handling as well as economic reasons we prefer to use finely ground limestone. About 1 gram of limestone per gram of peat moss is required. While adding this chemical agent to the aqueous peat moss slurry, the pH of the slurry is controlled at 7 or less. Immediately upon adding the chemical agent, gaseous chlorine is bubbled in the tank. The finer the bubbles of the gaseous chlorine, the more efficient the bleaching. Chlorine is bubbled in the tank and the pH of the solution decreases to about 3 to 4. From about 0.3 grams to 1 gram of chlorine per gram of peat moss is required in order to carry out the process of the present invention. We prefer to use from about 0.5 gram to 0.6 gram of chlorine per gram of peat moss in this step of our process. In a modification of this step, chlorine may be added until the pH is reduced to about 5.5 and then acid added to the slurry to further reduce the pH to 3 to 4 and obtain acceptable color levels in the final peat moss product.

If desired, the two previously described steps Box 4 and Box 5 may be carried out in one operation by utilizing calcium or sodium hypochlorite (Box 6). The hypochlorite is added to the peat moss slurry while controlling the pH at or below 7 using hydrochloric acid. When such a bleaching operation is carried out, from about 0.7 grams to 2.4 grams of hypochlorite and preferably from about 1.3 grams to 1.6 grams of hypochlorite per gram of peat moss is used in obtaining the desired color.

After a suitable time period, which will depend on the amount and concentration of peat moss being treated, the bleached peat moss is drained and dewatered to about 5 percent solids (Box 7). The drained peat moss is washed with water (Box 8) to a 1 to 3% concentration and again drained to 5% solids (Box 9). The dewatered peat moss is acid washed (Box 10) at a pH of approximately 15 using sulfuric acid or hydrochloric acid. These steps, involving the washing with water and acid, and the dewatering may be carried out on a rotary drum washer which is segmented into vacuum and spray areas. After the final wash, the consistency of the peat coming off should be at about 10% solids. The peat at this point has a minimum color level as measured on the Hunter L Scale of 65, preferably 70 and may be as high as 75 or higher. The Hunter Color Scale is a standard test as set forth in ASTM-D2244 using the color scale system C.

It should be pointed out that after the bleaching of the peat moss (Box 4 and 5 or Box 6), the only step that is absolutely critical to our new process and to produce our new product is the acid washing step (Box 10).

The bleached peat moss may be dried (Box 11) to low level moisture contents using air, solvent extraction, or other drying techniques well known in the art. In some instances, peat moss may become hydrophobic when dried to 10% or less moisture and a suitable wetting agent may be required to be added to the peat moss before it is incorporated in an absorbent dressing.

Although we have described the bleaching operation as a batch type operation, it could be easily operated as a continuous operation by techniques well known in the art. Mixing pumps could be used to feed in the limestone slurry and the chlorine gas at the required consistencies to a tower. The tower would be a counterflow tower of the peat moss and bleaching materials. The bleached peat moss could be pumped to a vacuum washer for the necessary water and acid washings. With good agitation and presentation of the chlorine and other chemicals involved, the peat moss can be bleached in about 3 to 4 hours.

In its broadest aspects, our new process involves treating a peat moss slurry with active chlorine in combination with certain alkali or alkaline earth salts and specifically the carbonates or hydroxides under generally acid conditions.

When using the hypochlorite bleaching agents, it may be theorized that hypochlorous acid is being generated in the acidification of the hypochlorite and the hypochlorous acid reacts with the peat moss (preferably the conjugated double bonds in the lignin component) to produce the desirable color.

The above is merely theory and though the exact mechanism or reaction being accomplished in our bleaching process is not known with certainty, we do know our new techniques are non-destructive of the peat moss structure while producing greatly enhanced color.

Figure 2:
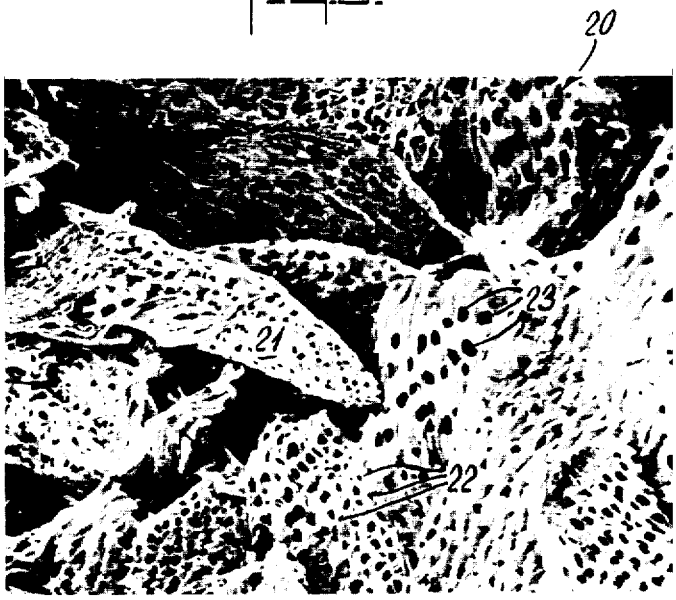
FIG. 2 is a photomicrograph of the starting peat moss material used in the process of the present invention at a magnification of approximately 170 times.
Figure 3:
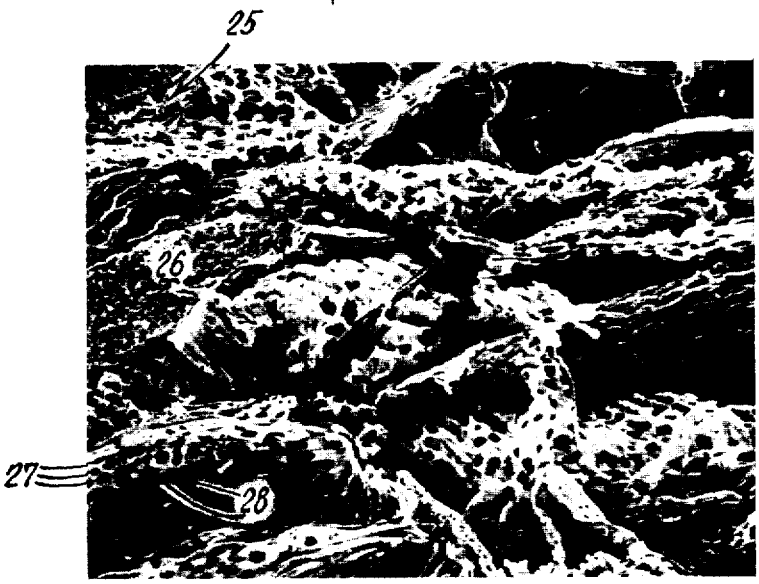
FIG. 3 is a photomicrograph of the peat moss resulting from carrying out the process of the present invention and is the new and improved bleached peat moss which is shown at a magnification of approximately 170 times.

Referring to FIGS. 2 and 3 of the drawings, there is shown in FIG. 2 starting peat moss 20 used in the process of the present invention.

The starting peat moss has a cellular structure one cell thick and is in the form of a leaf 21. The dimensions of the leaf range from about 0.3 to 0.8 millimeters. The leaf has a plurality of parallel rows 22 of cells 23 disposed over its surface. As is seen in FIG. 3, which shows the bleached peat moss 25 of the present invention having an enhanced color, the bleached peat moss has a cellular structure in the form of a leaf 26. The leaf has a plurality of rows 27 of cells 28 disposed over its surface. Individual cells in the leaf range in size from 15 microns to 30 microns.

Depending on the starting peat moss used in our new bleaching process, the resultant bleached peat moss will have a particle size distribution in the range of from 74 microns to 2000 microns and preferably from about 149 microns to 1410 microns.

As previously mentioned, our bleached peat moss has a liquid absorption capacity of at least 15 grams of liquid per gram of peat moss and preferably of at least 20 grams of liquid per gram of peat moss. The liquid absorption capacity is measured by placing a weighed amount of peat moss on a perforated screen and saturating the sample with water. The sample is drained to equilibrium at no pressure, about 20 minutes. The saturated sample is weighed and the weight recorded $W_w$. The sample is dried at 105° C. and the bone dry weight recorded $W_d$. The liquid absorption capacity of the peat moss is then determined according to the following formula:

$$(W_w - W_d)/W_d = \text{grams water/gram peat moss}$$

The following examples illustrate methods for bleaching peat moss in accordance with the present invention.

EXAMPLE I

A 700 gram sample of peat moss (Pit Moose, 10% moisture and previously classifed in order to keep the 10 to 100 mesh fraction, initial color: 50 Hunter) is introduced in a glasslined reactor containing 70 liters of water. The reactor bears a stirrer and a device for bubbling chlorine from the bottom of the reacting mass.

While the stirring mechanism is in operation, 700 grams of calcium carbonate (limestone, technical grade, mesh-325) is added in one portion to the reaction mixture. The slurry is kept under good stirring at room temperature (≈25° C.) and chlorine is bubbled at a rate of 7 grams per minute through the system.

After 90 minutes, a weight of 600 grams of $Cl_2$ has been added to the system and the pH slowly decreases to 3.0, from the initial value of 6.0, immediately after the addition of limestone.

The reaction is stopped and the bleached peat moss drained of the bleaching water. The drained bleached material is approximately 30% solids and is placed in the reactor and washed first with 70 liters of water containing 140 grams of HCl (37%), then with 70 liters of water containing 35 grams of HCl (37%) and finally with 70 liters of water.

The yield of bleached peat moss is 75% (calculated after drying to 10% moisture). The color of the bleached peat moss is 73 (Hunter scale) and the water holding capacity is 25 grams of liquid per gram of bleached peat moss.

EXAMPLE II

An experiment similar to Example I is performed except that the washing is done with sulfuric acid, using the following sequence:

First Washing:

140 grams of $H_2SO_4$ (98%), in 70 liters of water

Second Washing:

35 grams of $H_2SO_4$ (98%), in 70 liters of water

Third Washing:

70 liters of water

The end product is obtained at a 76% yield and has a good color of 74 (Hunter Scale) and a water holding capacity of 24 grams of $H_2O$/gram peat moss.

EXAMPLE III

The experimental procedure described in Example I is repeated in such a way that the addition of 600 grams of chlorine and 700 grams of $CaCO_3$ is replaced by the addition of calcium hypochlorite (600 grams).

The results obtained are essentially the same as those reported in Example I.

The pH of the mixture is kept below 6.0 by addition of HCl.

EXAMPLE IV

The experimental procedure described in Example II is modified in order to substitute sodium hypochlorite (550 grams per calcium hypochlorite). The bleached peat has a color of 76 (Hunter scale), with a water holding capacity of 29 grams of $H_2O$/gram peat moss. The yield is 78%.

EXAMPLE V

An experiment is performed as in Example I except that the starting peat moss (Ste-Marguerite) is much lighter in color (58 Hunter scale). With the same experimental procedure, the end product has an improved color to 76 (Hunter scale), with a water holding capacity of 30.5 grams of water per gram of peat moss.

EXAMPLE VI

An experiment is performed as in Example I except that slacked lime ($Ca(OH_2)$, 450 grams) is used instead of calcium carbonate. The bleached material has similar characteristics after washing as that produced in Example I.

EXAMPLE VII

Three reactors are each filled with about 35 to 40 liters of water and 350 to 400 grams of peat moss. This corresponds to a slurry of 1% of peat moss in each of the three reactors. The peat moss used is Atlantic peat moss, sphagum type. Two large auxiliary tanks are filled with 90 liters of water and 900 grams of the same peat moss. In each of these tanks there is placed 450 grams of ground limestone of minus 325 mesh. The peat moss has been previously classified so that only the fraction of 10 to 100 mesh is used. Peat moss is pumped at a rate of 2 liters per minute from one of the auxiliary tanks to the first reactor and then to the second reactor and then to the third reactor and then to a settling tank. A separate tank is filled with about 900 grams of raw peat moss. The water from the settling tank is pumped into this tank containing the 900 grams of the original raw peat moss and the bleached peat moss is removed at a concentration of 1% solids. The used water from the settling tank is pumped into the tank containing the raw peat moss and water added so that there are 90 liters in the tank. Four hundred fifty grams of limestone (−325 mesh) is fed into this tank. These tanks are then alternatively used to feed the system at the rate of 2 liters per minute. Chlorine is fed countercurrently from reactor three to reactor two to reactor one so the chlorine flow is countercurrent to the peat moss flow. The continuous system is operated for a period of 3 hours. The bleached peat moss is washed generally as described in Example I. During the operation, 180 liters of water is used, 1800 grams of raw peat moss and 900 grams of calcium carbonate. During the period 1270 grams of chlorine is fed to the system. The resultant bleached peat moss produced weighs 1620 grams so that for each gram of dry peat moss 0.78 grams of chlorine and 0.55 grams of calcium carbonate are used to accomplish the bleaching. The resultant bleached peat when measured on the Hunter L Scale has a color of 74.

Although a number of illustrative embodiments of the invention have been described in detail herein, it is to be understood that the invention is not limited to the precise embodiments and that various changes and modifications may be effected therein by one skilled in the art without departing from the scope or spirit of the present invention as defined in the appended claims.

What is claimed is:

1. A process for bleaching peat moss comprising; (a) forming a slurry of peat moss of a pumpable consistency, (b) treating said slurry with active chlorine in combination with a material selected from the group consisting of alkali carbonates, alkali hydroxides, alkaline earth carbonates and alkaline earth hydroxides while maintaining the pH of said slurry at 7 or less, (c) dewatering said slurry to a solids content of at least 5%, and (d) washing said dewatered slurry with acid to produce a bleached peat moss.

2. A process for bleaching peat moss comprising; (a) forming a slurry of peat moss of a pumpable consistency, (b) adding to said slurry from about 0.4 to 1.4 grams of a chemical agent selected from the group consisting of calcium carbonate, calcium oxide, calcium hydroxide and sodium carbonate per gram of peat while maintaining the pH of said slurry at 7 or less, (c) adding to said slurry containing the chemical agent from about 0.3 to 1 gram of gaseous chlorine per gram of peat while decreasing the pH of said slurry from 7 to the range of 3 to 4, (d) dewatering said chlorine treated slurry to a solids content of at least 5%, and (e) washing said dewatered slurry with acid to produce a bleached peat moss.

3. A process according to claim 2 wherein the slurry of a pumpable consistency has a solids content of about 1%.

4. A process according to claim 2 wherein from about 0.8 to 1 gram of chemical agent per gram of peat moss is used.

5. A process according to claim 2 wherein from about 0.5 to 0.6 grams of gaseous chlorine per gram of peat moss is used.

6. A process according to claim 2 wherein the chlorine treated slurry is dewatered to a solids content of at least 10%.

7. A process according to claim 2 wherein the chemical agent is calcium carbonate.

8. A process according to claim 2 wherein the chemical agent is calcium oxide.

9. A process according to claim 2 wherein the chemical agent is calcium hydroxide.

10. A process according to claim 2 wherein the slurry of a pumpable consistency has a solids content of about 1% and the chlorine treated slurry is dewatered to a solids content of at least 10%.

11. A process according to claim 10 wherein the chemical agent is calcium carbonate.

12. A process according to claim 2 wherein from about 0.8 to 1 gram of chemical agent per gram of peat moss and from about 0.5 to 0.6 gram of gaseous chlorine per gram of peat moss is used.

13. A process according to claim 12 wherein the chemical agent is calcium carbonate.

14. A process according to claim 12 wherein the slurry of a pumpable consistency has a solids content of about 1% and the chlorine treated slurry is dewatered to a solids content of at least 10%.

15. A process according to claim 14 wherein the chemical agent is calcium carbonate.

16. A process for bleaching peat moss comprising; (a) forming a slurry of peat moss of a pumpable consistency, (b) adding to said slurry from about 0.7 to 2.4 grams of a bleaching agent selected from the group consisting of sodium hypochlorite and calcium hypochlorite while maintaing the pH of said slurry at 7 or less, (c) dewatering said slurry to a solids content of at least 5%, and (d) washing said dewatered slurry with acid to produce a bleached peat moss.

17. A process according to claim 16 wherein the slurry of a pumpable consistency has a solids content of about 1%.

18. A process according to claim 16 wherein from about 1.3 to 1.6 grams of bleaching agent per gram of peat moss is used.

19. A process according to claim 16 wherein the slurry is dewatered to a solids content of at least 10%.

20. A process according to claim 16 wherein the bleaching agent is calcium hypochlorite.

21. A process according to claim 16 wherein the bleaching agent is sodium hypochlorite.

22. A process according to claim 16 wherein the slurry of a pumpable consistency has a solids content of about 1%, from about 1.3 to 1.6 grams of bleaching agent per gram of peat moss is used and the slurry is dewatered to a solids content of at least 10%.

23. A process according to claim 22 wherein the bleaching agent is calcium hypochlorite.

24. A process according to claim 22 wherein the bleaching agent is sodium hypochlorite.

25. A process for bleaching peat moss comprising; (a) separating raw peat moss into a fraction in the range of 10 mesh to 200 mesh, (b) forming a pumpable slurry of said fraction, (c) adding to said slurry from about 0.4 to 1.4 grams of a chemical agent selected from the group consisting of calcium carbonate, calcium oxide, calcium hydroxide and sodium carbonate per gram of peat while maintaining the pH of said slurry at 7 or less, (d) adding to said slurry containing the chemical agent from about 0.3 to 1 gram of gaseous chlorine per gram of peat while decreasing the pH of said slurry from 7 to the range of 3 to 4, (e) dewatering said chlorine treated slurry to a solids content of at least 5%, (f) washing said dewatered slurry with water and dewatering to a solids content of at least 5%, and (g) washing said dewatered and washed slurry with acid and dewatering to a solids content of at least 5% to produce a bleached peat moss.

26. A process according to claim 25 wherein said raw peat moss is separated into said fraction by forming a slurry of said raw peat moss and water and flowing said slurry through screens.

27. A process according to claim 25 wherein the fraction separated is in the range of 10 mesh to 100 mesh.

28. A process according to claim 25 wherein the pumpable slurry has a solids content of about 1%.

29. A process according to claim 25 wherein the chemical agent is calcium carbonate.

30. A process according to claim 25 wherein the chemical agent is calcium oxide.

31. A process according to claim 25 wherein the chemical agent is calcium hydroxide.

32. A process according to claim 25 wherein from about 0.8 to 1 gram of chemical agent per gram of peat moss is used.

33. A process according to claim 25 wherein from about 0.5 to 0.6 grams of gaseous chlorine per gram of peat moss is used.

34. A process according to claim 25 wherein the classification is a wet classification, the fraction separated is in the range of 10 mesh to 100 mesh, the pumpable slurry has a solids content of about 1%, from about 0.4 to 1 gram of chemical agent per gram of peat moss is used and from about 0.3 to 0.7 grams of gaseous chlorine per gram of peat moss is used.

35. A process according to claim 34 wherein the chemical agent is calcium carbonate.

36. A process according to claim 34 wherein the chemical agent is calcium oxide.

37. A process according to claim 34 wherein the chemical agent is calcium hydroxide.

38. A process for bleaching peat moss comprising; (a) classifying raw peat moss, (b) separating the fraction in the range of 10 mesh to 200 mesh, (c) forming a pumpable slurry of said fraction, (d) adding to said slurry from about 0.7 to 2.4 grams of a bleaching agent selected from the group consisting of sodium hypochlorite and calcium hypochlorite while maintaining the pH of said slurry at 7 or less, (e) dewatering said slurry to a solids content of at least 5%, (f) washing said dewatered slurry with water and dewatering to a solids content of at least 5%, and (g) washing said dewatered and washed slurry with acid and dewatering to a solids content of at least 5% to produce a bleached peat moss.

39. A process according to claim 38 wherein the classification is a wet classification.

40. A process according to claim 38 wherein the fraction separated is in the range of 10 mesh to 100 mesh.

41. A process according to claim 38 wherein the pumpable slurry has a solids content of about 1%.

42. A process according to claim 38 wherein the bleaching agent is sodium hypochlorite.

43. A process according to claim 38 wherein the bleaching agent is calcium hypochlorite.

44. A process according to claim 38 wherein from about 1.3 to 1.6 grams of bleaching agent per gram of peat moss is used.

45. A process according to claim 38 wherein the classification is a wet classification, the fraction separated is in the range of 10 mesh to 100 mesh, the pumpable slurry has a solids content of about 1% and from about 0.7 to 1.7 grams of bleaching agent per gram of peat moss is used.

46. A process according to claim 45 wherein the bleaching agent is sodium hypochlorite.

47. A process according to claim 45 wherein the bleaching agent is calcium hypochlorite.

48. A process for bleaching peat moss comprising; (a) wet classifying raw peat moss, (b) separating the fraction in the range of 10 mesh to 200 mesh, (c) forming a pumpable slurry of said fraction, (d) bleaching said slurry while maintaining the pH at 7 or less, (e) dewatering said slurry to a solids content of at least 5%, (f) washing said dewatered slurry with water, (g) dewatering said washed slurry to a solids content of at least 5%, (h) washing said dewatered slurry with acid, and (i) dewatering said acid washed slurry to a solids content of at least 5% to produce a peat moss having a minimum color of 70 as measured on the Hunter L. Scale.

49. A process according to claim 48 wherein the fraction separated is in the range of 10 mesh to 100 mesh.

50. A process according to claim 48 wherein the pumpable slurry has a solids content of about 1%.

51. A process according to claim 48 wherein the slurry, washed slurry, and the acid washed slurry are each dewatered to a solids content of at least 10%.

52. A process according to claim 51 wherein the fraction separated is in the range of 10 mesh to 100 mesh and the pumpable slurry has a solids content of about 1%.

53. Bleached peat moss having a minimum color of 65 as measured on the Hunter L Scale and a minimum liquid absorption capacity of 15 grams of liquid per gram of peat moss.

54. Bleached peat moss according to claim 53 having a minimum color of 70 as measured on the Hunter L Scale.

55. Bleached peat moss according to claim 53 having a minimum liquid absorption capacity of 20 grams of liquid per gram of peat moss.

56. Bleached peat moss according to claim 55 having a minimum color of 70 as measured on the Hunter L Scale.

57. Bleached peat moss having a minimum color of 65 as measured on the Hunter L Scale and a particle size distribution wherein at least 85% by weight of the peat moss is between 74 microns and 1410 microns.

58. Bleached peat moss according to claim 57 having a minimum color of 70 as measured on the Hunter L Scale.

59. Bleached peat moss according to claim 57 wherein at least 90% by weight of the peat moss has a particle size distribution between 149 microns and 1410 microns.

60. Bleached peat moss according to claim 59 having a minimum color of 70 as measured on the Hunter L Scale.

61. Bleached peat moss according to claim 57 having a minimum liquid absorption capacity of 15 grams of liquid per gram of peat moss.

62. Bleached peat moss according to claim 60 having a minimum liquid absorption capacity of 20 grams of liquid per gram of peat moss.

63. Bleached peat moss having a minimum color of 65 as measured on the Hunter L Scale with the majority of said peat moss being in the form of a leaf, said leaf being one cell-layer thick, and having a plurality of parallel rows of cells disposed over the surface.

64. Bleached peat moss according to claim 63 wherein the peat moss leaves have an individual size of greater than 149 microns.

65. Bleached peat moss according to claim 63 having a minimum color of 70 as measured on the Hunter L Scale.

66. Bleached peat moss according to claim 65 wherein the peat moss leaves have an individual size of greater than 149 microns.

67. Bleached peat moss according to claim 63 having a liquid absorption capacity of at least 15 grams of liquid per gram of peat moss.

68. Bleached peat moss according to claim 66 having a liquid absorption capacity of at least 20 grams of liquid per gram of peat moss.

69. Bleached peat moss according to claim 63 having a minimum color of 75 as measured on the Hunter L Scale, and a particle size distribution range wherein 90% by weight of the peat moss is between 149 microns and 1410 microns.

70. Bleached peat moss according to claim 69 having a liquid absorption capacity of at least 20 grams of liquid per gram of peat moss.

* * * * *